US009124994B2

(12) United States Patent
Corti et al.

(10) Patent No.: US 9,124,994 B2
(45) Date of Patent: Sep. 1, 2015

(54) SYSTEM FOR PROGRAMMING SPECIAL FUNCTION BUTTONS FOR HEARING ASSISTANCE DEVICE APPLICATIONS

(75) Inventors: Deborah Corti, Pompano Beach, FL (US); David A. Preves, Bradenton, FL (US); J. Virgil Bradley, Plymouth, MN (US); Jeffrey Paul Solum, Deephaven, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 284 days.

(21) Appl. No.: 12/901,697

(22) Filed: Oct. 11, 2010

(65) Prior Publication Data

US 2011/0249841 A1 Oct. 13, 2011

Related U.S. Application Data

(60) Provisional application No. 61/321,599, filed on Apr. 7, 2010.

(51) Int. Cl.
*H04R 25/00* (2006.01)

(52) U.S. Cl.
CPC ..... *H04R 25/70* (2013.01); *H04R 25/558* (2013.01); *H04R 25/554* (2013.01); *H04R 2225/61* (2013.01)

(58) Field of Classification Search
CPC ..... H04R 25/00; H04R 25/30; H04R 25/305; H04R 25/50; H04R 25/55; H04R 25/558; H04R 2225/55; H04R 2225/39
USPC ..... 381/312, 314–315, 322, 323, 324
See application file for complete search history.

(56) References Cited

U.S. PATENT DOCUMENTS 5,710,819 A 1/1998 Topholm et al.
5,721,783 A * 2/1998 Anderson ..... 381/328

(Continued)

FOREIGN PATENT DOCUMENTS

DK 2375786 T3 10/2013
EP 1757343 B1 5/2013

(Continued)

OTHER PUBLICATIONS

European Application Serial No. 11250440.2, European Search Report mailed Sep. 1, 2011, 7 pgs.

(Continued)

*Primary Examiner* — Paul S Kim
*Assistant Examiner* — Sabrina Diaz
(74) *Attorney, Agent, or Firm* — Schwegman Lundberg & Woessner, P.A.

(57) ABSTRACT

Disclosed herein, among other things, are apparatus and methods to provide improved control of hearing assistance devices and hearing assistance applications. The present apparatus and method can be deployed on a hearing aid, a device in communication with the hearing aid, or on both. In one embodiment a programmable control, including, but not limited to a button or switch or sensor or microphone is adapted to provide control of the function or settings of the hearing aid. In one embodiment, a programmable control for a device including, but not limited to a button or switch or sensor or microphone is adapted to provide wireless control of the function or settings of the hearing aid. In various embodiments, a programmable control for the hearing aid and a programmable control of the device are used to provide wireless control of the function or settings of the hearing aid.

21 Claims, 2 Drawing Sheets

(56) References Cited

U.S. PATENT DOCUMENTS

| | | | | |
|---|---|---|---|---|
| 6,229,900 | B1 * | 5/2001 | Leenen | 381/314 |
| 6,724,902 | B1 | 4/2004 | Shennib et al. | |
| 7,242,778 | B2 * | 7/2007 | Csermak et al. | 381/60 |
| 7,349,549 | B2 * | 3/2008 | Bachler et al. | 381/314 |
| 8,099,289 | B2 * | 1/2012 | Mozer et al. | 704/275 |
| 8,437,860 | B1 * | 5/2013 | Crawford et al. | 607/55 |
| 2005/0281424 | A1 * | 12/2005 | Rass | 381/312 |
| 2007/0071264 | A1 | 3/2007 | Baechler et al. | |
| 2007/0254728 | A1 | 11/2007 | Moallemi et al. | |
| 2007/0269065 | A1 * | 11/2007 | Kilsgaard | 381/315 |
| 2009/0074215 | A1 * | 3/2009 | Schumaier | 381/314 |
| 2009/0087004 | A1 * | 4/2009 | Boguslavskij | 381/314 |
| 2009/0196448 | A1 | 8/2009 | Schumaier | |
| 2009/0208043 | A1 * | 8/2009 | Woods et al. | 381/315 |
| 2009/0239587 | A1 | 9/2009 | Negron et al. | |
| 2009/0316941 | A1 | 12/2009 | Lowmiller et al. | |

FOREIGN PATENT DOCUMENTS

| | | | |
|---|---|---|---|
| EP | 2375786 | B1 | 7/2013 |
| WO | WO-9965275 | A1 | 12/1999 |
| WO | WO-2009196448 | A1 | 8/2009 |
| WO | WO-2009118221 | A1 | 10/2009 |
| WO | WO-9965275 | | 12/2009 |

OTHER PUBLICATIONS

European Application Serial No. 11250440.2, Office Action mailed May 4, 2012, 6 pgs.

European Application Serial No. 11250440.2, Response filed Nov. 7, 2012 to Office Action mailed May 4, 2012, 8 pgs.

"European Application Serial No. 11250440.2, Notice of Opposition mailed May 2, 2014", 24 pgs.

"European Application Serial No. 11250440.2, Response filed Dec. 15, 2014 to Notice of Opposition mailed May 2, 2014", 19 pgs.

* cited by examiner

SYSTEM FOR PROGRAMMING SPECIAL FUNCTION BUTTONS FOR HEARING ASSISTANCE DEVICE APPLICATIONS

The present application claims the benefit under 35 U.S.C. 119(e) of U.S. Provisional Patent Application Ser. No. 61/321,599, filed Apr. 7, 2010, which is incorporated herein by reference in its entirety.

FIELD OF THE INVENTION

The present subject matter relates generally to programmable controls for use in hearing assistance device applications.

BACKGROUND

Hearing assistance devices, such as hearing aids, typically include a signal processor in communication with a microphone and receiver. Such designs are adapted to perform a great deal of processing on sounds received by the microphone. More and more hearing assistance devices include a wireless communication option which provides a way to communicate with a hearing assistance device using another device. Such devices may have their own wireless protocols for communications or may use an industry standard protocol.

However, as such hearing assistance device designs get smaller, they typically have less available volume to hold the electronics and means to control the device. Hearing assistance devices can be controlled by other devices, but many of the user interfaces are difficult to work with. Accordingly, there is a need in the art for apparatus and methods to provide improved control of a hearing assistance device.

SUMMARY

Disclosed herein, among other things, are apparatus and methods to provide improved control of hearing assistance devices and hearing assistance applications. The present apparatus and method can be deployed on the hearing assistance device, a device in communication with the hearing assistance device, or on both. In one embodiment a programmable control, including, but not limited to a button or switch or sensor or microphone is adapted to provide control of the function or settings of the hearing assistance device. In one embodiment, a programmable control for a device including, but not limited to a button or switch or sensor or microphone is adapted to provide wireless control of the function or settings of the hearing assistance device. In various embodiments, a programmable control for the hearing assistance device and a programmable control of the wireless control device are used to provide wireless control of the function or settings of the hearing assistance device. Other embodiments are possible without departing from the scope of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device and it is understood that their use in the description is intended to demonstrate the present subject matter, but not in a limited or exclusive sense. Hearing assistance device designs, such as hearing aid designs are typically configured to be inconspicuous and to take up the least amount of volume possible. Therefore, hearing aid designs have to carefully allocate space for components and controls. Modern hearing aid designs are highly programmable and require innovative approaches to controlling the hearing aid. Such designs may also be wireless and may communicate with other devices having programmable controls to provide controllable functions or settings.

Disclosed herein, among other things, are apparatus and methods to provide improved control of hearing assistance devices and hearing assistance applications. The present apparatus and method can be deployed on a hearing aid, for example, a device in communication with the hearing aid, or on both. In one embodiment a programmable control, including, but not limited to a button or switch or sensor or microphone is adapted to provide control of the function or settings of the hearing aid. In one embodiment, a programmable control for a separate device including, but not limited to, a button or switch or sensor or microphone is adapted to provide wireless control of the function or settings of the hearing aid. In various embodiments, a programmable control for the hearing aid and a programmable control of the device are used to provide wireless control of the function or settings of the hearing aid. In various embodiments, the function or settings of the hearing aid are controlled using a sensor such as a multi-axis accelerometer. In various embodiments, the function or settings of the hearing aid are controlled using voice commands via a microphone input and voice recognition software and hardware. Other embodiments are possible without departing from the scope of the present subject matter.

Figure 1:
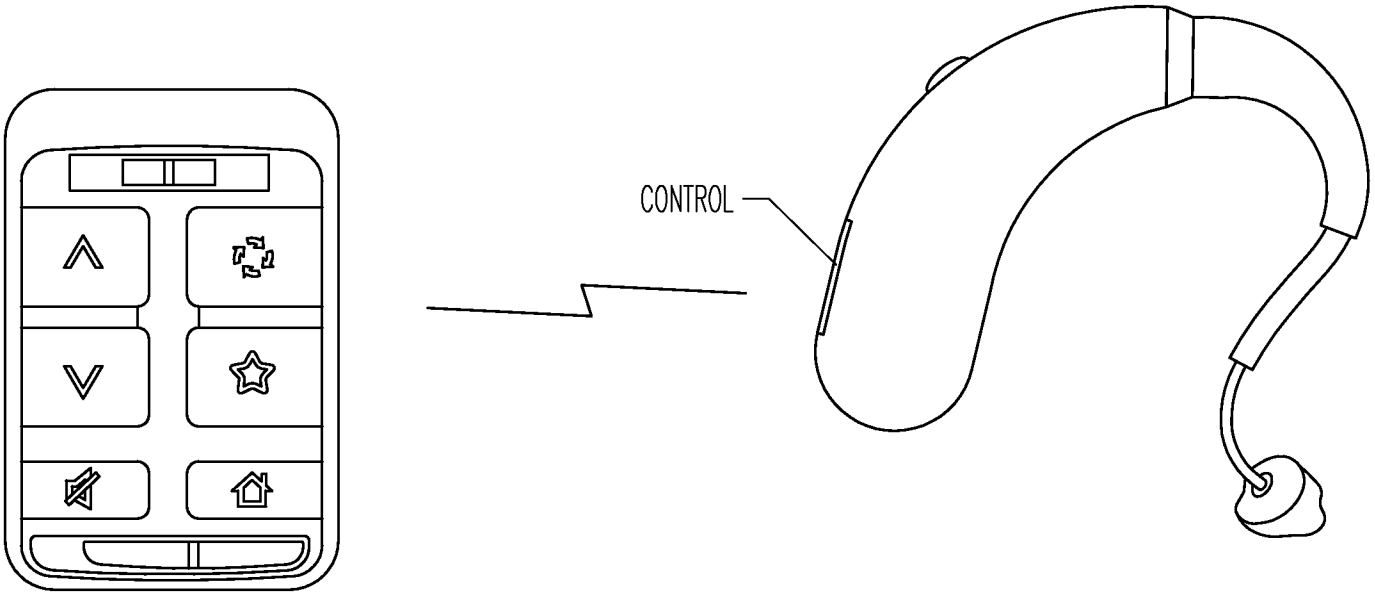
FIG. 1 shows a hearing assistance device with a control and a wireless remote control with configurable buttons according to one embodiment of the present subject matter.

FIG. 1 shows a hearing assistance device, such as a hearing aid, with a control in wireless communication with a remote control having configurable controls, according to one embodiment of the present subject matter. The hearing aid demonstrated in FIG. 1 is a receiver-in-canal (RIC) hearing aid with a control, but it is understood that any hearing aid with a control can be used without departing from the scope of the present subject matter. This device will be referenced as a head worn device in the following discussion. It is understood that any head worn hearing assistance device may be used and that the hearing aid is only demonstrative and not limiting.

The remote control in FIG. 1 is in wireless communication with the hearing aid to assist in controlling the hearing aid. The remote control has configurable buttons to facilitate control and programming of the hearing aid. In various embodiments, the remote control includes one or more sensors and/or one or more microphones in addition to or in place of the configurable buttons to facilitate control and programming of the hearing aid.

Head Worn Device Programmable Controls

The present subject matter includes a programmable control on a head worn device, such as a hearing aid. In various embodiments, the programmable control is a button. In various embodiments, the control is a switch. In various embodiments, the control is a capacitive switch or sensor. One example of a sensor includes a multi-axis accelerometer. In various embodiments, the control is a microphone using voice commands or other acoustic inputs. Other controls exist without departing from the scope of the present subject matter.

In various embodiments, the programmable control is programmable for a number of control functions. Some of these control functions include but are not limited to the following: to change between omnidirectional and directional microphone modes; to alter the input among induction coil (alone), induction coil & microphone (mixed), omni and/or directional microphone, direct audio input, audio input via frequency modulation (FM) transmission, audio input via 900 MHz wireless transmission; and programmable combinations thereof; to initiate a device self diagnostic, where the head worn device tests its own components (some examples include but are not limited to a test of its microphone(s), receiver, circuitry, EEPROM, digital signal processor, and/or power supply) and communicates the diagnostic results to the user of the device or a professional; to create an audio or statistical recording of an environment, to save the recording and to allow retrieval/replay of the recording; to initiate or activate a self-learning algorithm in the head worn device and/or remote control; and/or to pause or resume audio streaming of an audio signal.

In various embodiments, the configuration of an individual control or multiple controls on the head worn device may be: altered by software and sent to the device via wireless (for example, including but not limited to 900 MHz wireless communication); and/or altered by software and sent to the head worn device via a wired connection; altered by a mode button on the head worn device (including, but not limited to, a momentary press or a push and hold of a mode button or multiple button presses to alter button configuration). Other alterations may be incorporated without departing from the scope of the present subject matter. For example, a remote device could be used to alter the settings of the individual or multiple controls on the head worn device.

In various embodiments, the mode setting is indicated to the user by indicators including, but not limited to, one or more of the following: audible tonal indicators presented by the head worn device; audible speech indicators presented by the head worn device; visual LED indicators on the remote control; and/or visual LCD display on the remote control.

Wireless Remote Device

The present subject matter includes programmable controls on a wireless remote device. In various embodiments, the programmable control is a button. In various embodiments, the control is a switch. In various embodiments, the control is a capacitive switch or sensor. An example of a sensor used as a programmable control includes a multi-axis accelerometer. In various embodiments, the control is a microphone used to process voice commands. Other controls exist without departing from the scope of the present subject matter.

In various embodiments, the programmable control is programmable for a number of control functions. Some of these control functions include but are not limited to the following: to change between omnidirectional and directional microphone modes; to alter the input among induction coil (alone), induction coil & microphone (mixed), omni and/or directional microphone, direct audio input, audio input via frequency modulation (FM) transmission, audio input via 900 MHz wireless transmission; and programmable combinations thereof; to initiate a device self diagnostic, where the head worn device tests its components (some examples include but are not limited to a test of its microphone(s), receiver, circuitry, EEPROM, digital signal processor, and/or power supply) and communicates the diagnostic results to the user of the device or a professional; to create an audio or statistical recording of an environment, to save the recording and to allow retrieval/replay of the recording; to initiate or activate a self-learning algorithm in the head worn device and/or remote control; and/or to pause or resume audio streaming of an audio signal.

In various embodiments, the configuration of an individual control or multiple controls on the remote control may be: altered by software and sent to the remote control via wireless (for example, including but not limited to 900 MHz wireless communication); and/or altered by software and sent to the remote control device via a wired connection; altered by a mode button on the remote control (including, but not limited to, a momentary press or a push and hold of a mode button or multiple button presses to alter button configuration). Other alterations may be incorporated without departing from the scope of the present subject matter.

In various embodiments, the mode setting is indicated to the user by indicators including, but not limited to, one or more of the following: audible tonal indicators presented by the remote control; audible speech indicators presented by the remote control; visual LED indicators on the remote control; and/or visual LCD display on the remote control.

Range Control

Figure 2:
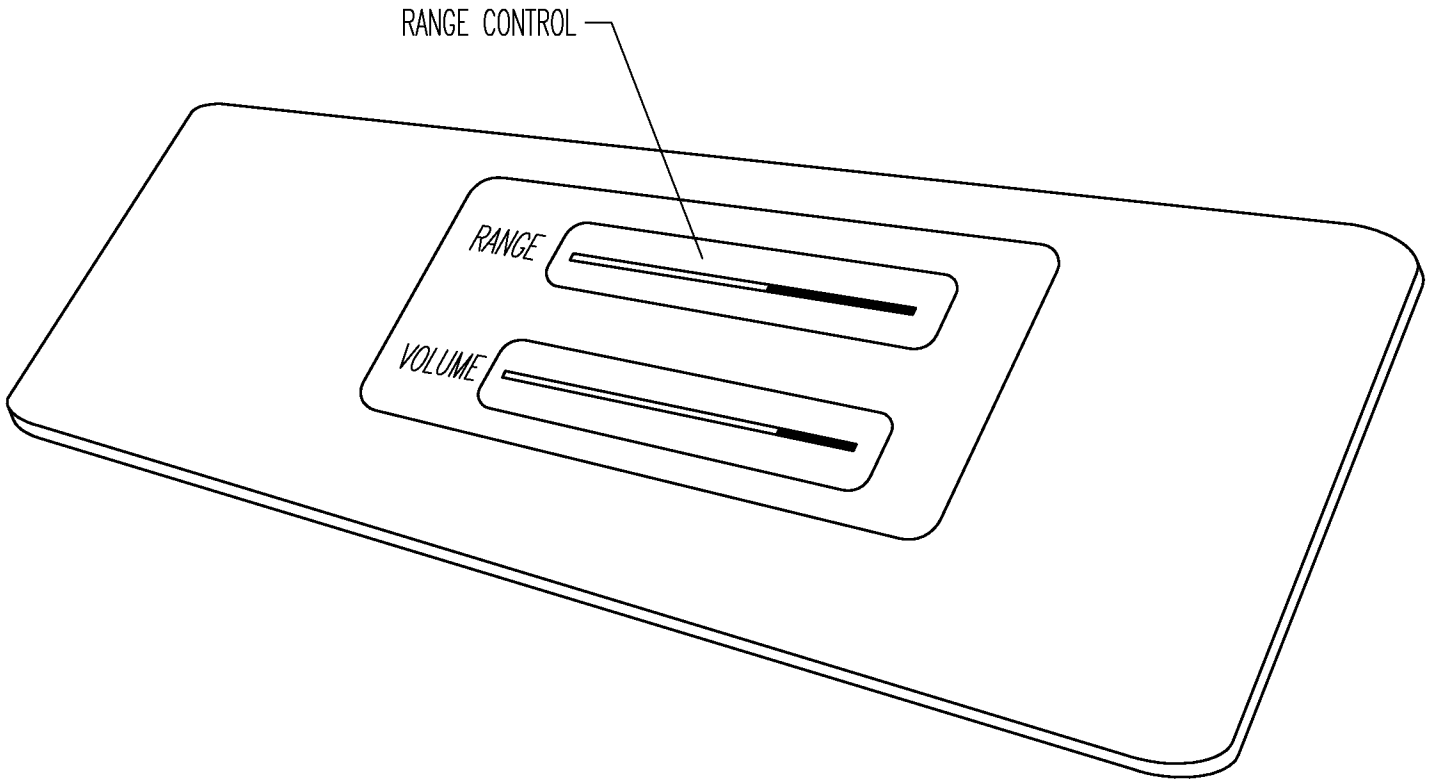
FIG. 2 shows a wireless device with range control according to one embodiment of the present subject matter.

FIG. 2 shows a wireless device with range control according to one embodiment of the present subject matter. The present subject matter allows a user to control the radio frequency (RF) range on a wireless (including, but not limited to, 900 MHz wireless communications) audio streaming device using a range control on the remote device. When the user decreases the range via the range control, the power to the wireless transmission (e.g., 900 MHz transmission) will be lower, resulting in a smaller RF transmission range for the audio stream. When the user increases the range via the range control, the power to the wireless transmission (e.g., 900 MHz transmission) will be higher, resulting in a larger RF transmission range for the audio stream. In various embodiments the remote control can be used to transmit commands and information which are received by the audio streaming device and sent to the head worn device. Such communications may be unidirectional or bidirectional. In various embodiments the range control is adjustable from the remote control. Other embodiments exist without departing from the scope of the present subject matter.

It is understood that other communications frequencies may be employed in different geographical regions. Furthermore, it is understood that bidirectional and unidirectional communication modes are possible. The configurations, buttons, and examples set forth herein are intended to demonstrate the present subject matter and not in an exhaustive or exclusive sense.

The present subject matter can be used for a variety of hearing assistance devices, including but not limited to, assistive listening devices, tinnitus masking devices, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

In various embodiments, the hearing aid (or aids) is programmed during a fitting session to respond to generic commands, such as special feature commands, from a remote control device, such as a wireless remote control device. In various embodiments, the generic commands are initiated on the remote control device using button presses, button press and holds of varying durations, and/or multiple button presses. The generic commands are generated by shaking the remote control device and using a multi-axis accelerometer to sense the user's intention and send a generic command to the hearing aid, in various embodiments. In various embodiments, the remote control device includes a microphone and a processor to convert voice commands into commands sent to the hearing aid, the hearing aid commands including, for example, volume up and down, memory change and noise management. The microphone and processor on the remote device are used to sense the acoustic environment and make automatic adjustments via wireless commands to the hearing aid, in various embodiments.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A system for controlling a hearing assistance device, the system comprising:

a wireless remote control including a plurality of controls including a first programmable control; and a hearing assistance device, configured to receive a wireless transmission including commands and information from the remote control, the hearing assistance device including a second programmable control on a housing of the hearing assistance device;

wherein the second programmable control is configured to provide a programmable control function, wherein the control function is programmable to switch between two or more of: microphone mode, device input mode, self diagnostic mode, record mode, and pause/resume mode, and wherein the second programmable control of the hearing assistance device includes a user operable control configured to be programmed for the programmable control function using wireless communications from the wireless remote control.

2. The system of claim 1, wherein the plurality of controls includes a button.

3. The system of claim 2, wherein the button is configured to be pressed and held to initiate the wireless transmission to the hearing assistance device.

4. The system of claim 2, wherein the button is configured to be pressed multiple times to initiate the wireless transmission to the hearing assistance device.

5. The system of claim 1, wherein the plurality of controls includes a switch.

6. The system of claim 1, wherein the plurality of controls includes a sensor.

7. The system of claim 6, wherein the sensor includes a multi-axis accelerometer.

8. The system of claim 7, wherein the wireless remote control is configured to be shaken and the multi-axis accelerometer is configured to sense the shaking and to initiate the wireless transmission to the hearing assistance device.

9. The system of claim 1, wherein the plurality of controls includes a microphone.

10. The system of claim 9, wherein the wireless remote control includes a processor.

11. The system of claim 10, wherein the microphone is configured to detect voice commands and the processor is configured to convert the voice commands into commands and information for the wireless transmission to the hearing assistance device.

12. A method for controlling a hearing assistance device, the method comprising:

programming a programmable control on a housing of the hearing assistance device for a programmable control function using wireless communications from a wireless remote control including a plurality of controls, wherein the programmable control includes a user operable control and wherein the programmable control function is programmable to switch between two or more of: microphone mode, device input mode, self diagnostic mode, record mode, and pause/resume mode based on the wireless communications received from the wireless remote control.

13. The method of claim 12, wherein programming the control includes programming the control to switch the hearing assistance device between omnidirectional and directional microphone modes.

14. The method of claim 12, wherein programming the control includes changing an input of the hearing assistance device to one of: induction coil, induction coil and microphone, directional microphone, direct audio input, audio input via frequency modulation (FM) transmission, audio input via 900 MHz wireless transmission and programmable combinations of inputs.

15. The method of claim 12, wherein programming the control includes initiating a hearing assistance device self diagnostic.

16. The method of claim 15, further comprising communicating results of the hearing assistance device self diagnostic from the hearing assistance device to a user of the wireless remote control.

17. The method of claim 12, wherein programming the control includes initiating an audio or statistical recording of an environment.

18. The method of claim 12, wherein programming the control includes using wireless communications initiated by the wireless remote control including a button control.

19. The method of claim 12, wherein programming the control includes using wireless communications initiated by the wireless remote control including a switch control.

20. The method of claim 12, wherein programming the control includes using wireless communications initiated by the wireless remote control including a sensor control.

21. The method of claim 12, wherein programming the control includes using wireless communications initiated by the wireless remote control including a microphone control.

* * * * *